United States Patent [19]

Holzapfel

[11] 4,350,009

[45] Sep. 21, 1982

[54] COMBUSTION CHAMBER FOR A GAS TURBINE

[75] Inventor: Immanuel Holzapfel, Stuttgart, Fed. Rep. of Germany

[73] Assignee: Daimler-Benz Aktiengesellschaft, Stuttgart, Fed. Rep. of Germany

[21] Appl. No.: 192,992

[22] Filed: Oct. 2, 1980

Related U.S. Application Data

[63] Continuation of Ser. No. 917,482, Jun. 21, 1978, abandoned.

[30] Foreign Application Priority Data

Jun. 21, 1977 [DE] Fed. Rep. of Germany ..... 2727795

[51] Int. Cl.[3] ..... F02C 7/22; F02C 9/00

[52] U.S. Cl. ..... 60/39.23; 60/39.36; 60/737; 60/748; 60/749

[58] Field of Search ..... 60/737, 749, 748, 39.23, 60/39.36; 431/171, 177, 182, 187; 239/419, 419.3, 404, 422

[56] References Cited

U.S. PATENT DOCUMENTS

| | | | |
|---|---|---|---|
| 2,698,050 | 12/1954 | Bloomer | 60/748 |
| 2,771,744 | 11/1956 | Johnson | 60/749 |
| 3,007,310 | 11/1961 | Eisele | 60/748 |
| 3,684,186 | 8/1972 | Helmrich | 239/422 |
| 3,893,296 | 7/1975 | Fredricksen | 60/737 |
| 3,912,164 | 10/1975 | Lefebvre | 60/748 |
| 4,078,377 | 3/1978 | Owens | 60/737 |
| 4,150,539 | 4/1979 | Rubins | 60/749 |
| 4,199,934 | 4/1980 | Meyer | 60/749 |

*Primary Examiner*—Douglas Hart

*Attorney, Agent, or Firm*—Antonelli, Terry & Wands

[57] ABSTRACT

A combustion chamber for a gas turbine, in particular for motor vehicles, with an atomizer nozzle for the fuel fed to a pre-chamber, in which the inlet cross section for the primary air is changed by the longitudinal movement of a deflection member extending through the inlet opening of the combustion chamber. The deflection member serves as a flame holder for the stabilization of the combustion in the primary air zone while the air-atomizing nozzle is constructed ring-shaped and is provided with swirl slots in such a manner that the mixture of the fuel and of the atomizing air enters as an annular jet the primary air inlet channel, impinges approximately perpendicularly onto the primary air flow, penetrates the same and uniformly mixes with the same on its way to the inlet into the primary zone. The quantity of the primary air to be supplied is thereby automatically adjustable.

15 Claims, 4 Drawing Figures

COMBUSTION CHAMBER FOR A GAS TURBINE

This is a continuation of application Ser. No. 917,482 filed June 21, 1978, now abandoned.

The present invention relates to a combustion chamber for a gas turbine, preferably for motor vehicles, with an atomizer nozzle, especially an air-atomizing nozzle for the fuel supplied to a pre-chamber, in which the inlet cross section for the primary air is changed by the longitudinal movement of a deflection body projecting through the inlet opening of the combustion chamber, which deflection body serves as flame holder for the stabilization of the combustion of the primary air.

A combustion chamber of this type is described in the German Offenlegungsschrift No. 25 03 128.

In such combustion chambers, the fuel is admixed to the combustion air in the inlet or inflow channel to the primary zone in order to achieve as homogeneous as possible a fuel/air mixture, in which the fuel evaporates completely or at least to a large extent, before the mixture enters the primary zone by way of the inlet cross section which is formed between the flame holder and the outer wall of the inlet or inflow channel. The fuel should therefore be evaporated at least to a large extent before the combustion reactions begin. In order to achieve a high degree of complete combustion within the entire operating range of the gas turbine and a combustion low in harmful components such as nitrogen oxide, it is necessary to constantly match the primary air quantity to the fuel quantity necessary at the respective operating point in order to thus obtain a mixing ratio in the primary zone matched to the lowest possible harmful component emission. This adjustment is achieved in that the inlet cross section into the primary zone is enlarged or reduced depending on the demanded power output by a longitudinal movement of the flame holder of the inlet cross section in dependence on the injected fuel quantity and on the air temperature in the inlet or inflow channel.

In that connection, a good mixture distribution in the inlet or inflow channel is quite decisive in order to avoid zones with a rich mixture which have as a consequence, local non-permissively high combustion temperatures. Additionally, it is thereby essential that the flame holder can be displaced easily from the outside in order to attain the readjustment of the inlet cross section and therewith the primary quantity in the shortest possible time with lowest possible energy application and thus to achieve with each change of the operating conditions immediately optimum mixture ratios.

It is the aim of the present invention to fulfill these requirements in the best possible manner and to a greater extent than possible heretofore by an improvement of the construction of the combustion chamber.

The underlying problems are solved according to the present invention in that the air atomizer nozzle is constructed ring-shaped with helical or swirl slots in such a manner that the mixture of fuel and of atomizing air enters the primary air inlet channel as annular jet, impinges approximately perpendicularly onto the primary air stream, penetrates the same and mixes with the same uniformly on its way to the inlet into the primary zone, and in that the quantity of the primary air to be introduced is adjustable automatically. It should be considered thereby that the quantity of the through-flowing atomizing air amounts at most to only 1% of the entire air through-put, i.e., of total rate of air flow through the combustion chamber. For the realization of this control, the shaft of the flame holder can be extended through the correspondingly constructed nozzle and can be actuated from the outside in such a manner that the quantity of the primary air to be introduced is optimally controlled.

The ring-shaped construction of the air-atomizing nozzle which distributes the fuel already during the discharge over as large a circumference as possible, therefore makes it possible to insert the flame holder in a constructively simple manner into the head of the combustion chamber and to actuate the same from the outside with simple means. A portion of the atomizing air can thereby be supplied through cross bores to an annular channel and to labyrinth seals adjoining the same at the periphery of the flame holder shaft and as a result thereof the through-flow of hot combustion air as leakage air along the shaft can be prevented.

The automatic adjustment can thereby be realized by a movement of a linkage extending transversely to the longitudinal movement of the deflection body, by means of which a ring, pivotally or rigidly connected with the flame holder shaft and guided in helical grooves, is so pivoted that a longitudinal movement of the deflection body results therefrom.

If the gas turbine serves as a drive of, for example, a passenger motor vehicle, the change of the injected fuel quantity takes place so rapidly that as a result of the mass- and heat-inertia of the different components of the gas turbine, conditions may occur, in which a stable combustion can no longer be maintained for short periods of time also with a change of the primary air inlet cross section. This condition occurs in particular during rapid decelerations. Since also during the start, i.e., with a cold combustion air, the drive will take place with a relatively lean mixture, an ignition source of particularly high energy is required in this case. In all of these cases, it is therefore appropriate to provide a separate ignition burner or auxiliary burner. This ignition or auxiliary burner is advantageously so constructed that it is built into the flame holder shaft and concentrically thereto and in that air is supplied thereto centrally through the deflection body and fuel is supplied thereto in an annular tubular member, whereby the ignition electrode additionally extends therein in the axis of the deflection body.

This auxiliary burner in an advantageous manner is continuously in operation in order not to obtain a non-permissive increase of the hydrocarbon emission during the re-ignition after the turning-off of the main fuel during strong decelerations.

The ignition, or auxiliary burner concentrically built into the flame holder shaft is equipped with a pressure or air-atomizing nozzle of conventional type. With a view toward the harmful component emission, the construction with an air-atomizing nozzle is preferable.

Accordingly, it is an object of the present invention to provide a combustion chamber for gas turbines which avoids by simple means the aforementioned shortcomings and drawbacks encountered in the prior art.

Another object of the present invention resides in a combustion chamber for gas turbines, especially for use with passenger motor vehicles, which assures completely satisfactory operation under all conditions coupled with a low emission in harmful components.

A further object of the present invention resides in a combustion chamber for gas turbines which enables an optimization of the mixture conditions under changing operating conditions by extremely simple means.

Still a further object of the present invention resides in a combustion chamber for gas turbines for use with motor vehicles which permits a rapid change and adaptation of the fuel/air mixture to rapidly changing operating conditions while avoiding excessively high combustion temperatures.

Still another object of the present invention resides in a gas turbine with a combustion chamber of the type described above which enables a simple control with low energy requirements for its actuation, so as to obtain substantially instantaneously optimum mixture conditions with every change of the operating conditions.

A further object of the present invention resides in a combustion chamber for a gas turbine which can be easily assembled, utilizes relatively few parts for its control and assures high reliability for optimum operating conditions.

Still another object of the present invention resides in a combustion chamber for gas turbines, especially for passenger motor vehicles, which adapts itself particularly readily for automatic control in the operation of the vehicle.

These and other objects, features and advantages of the present invention will become more apparent from the following description when taken in connection with the accompanying drawing which shows, for purposes of illustration only, two embodiments in accordance with the present invention, and wherein.

Figure 1:
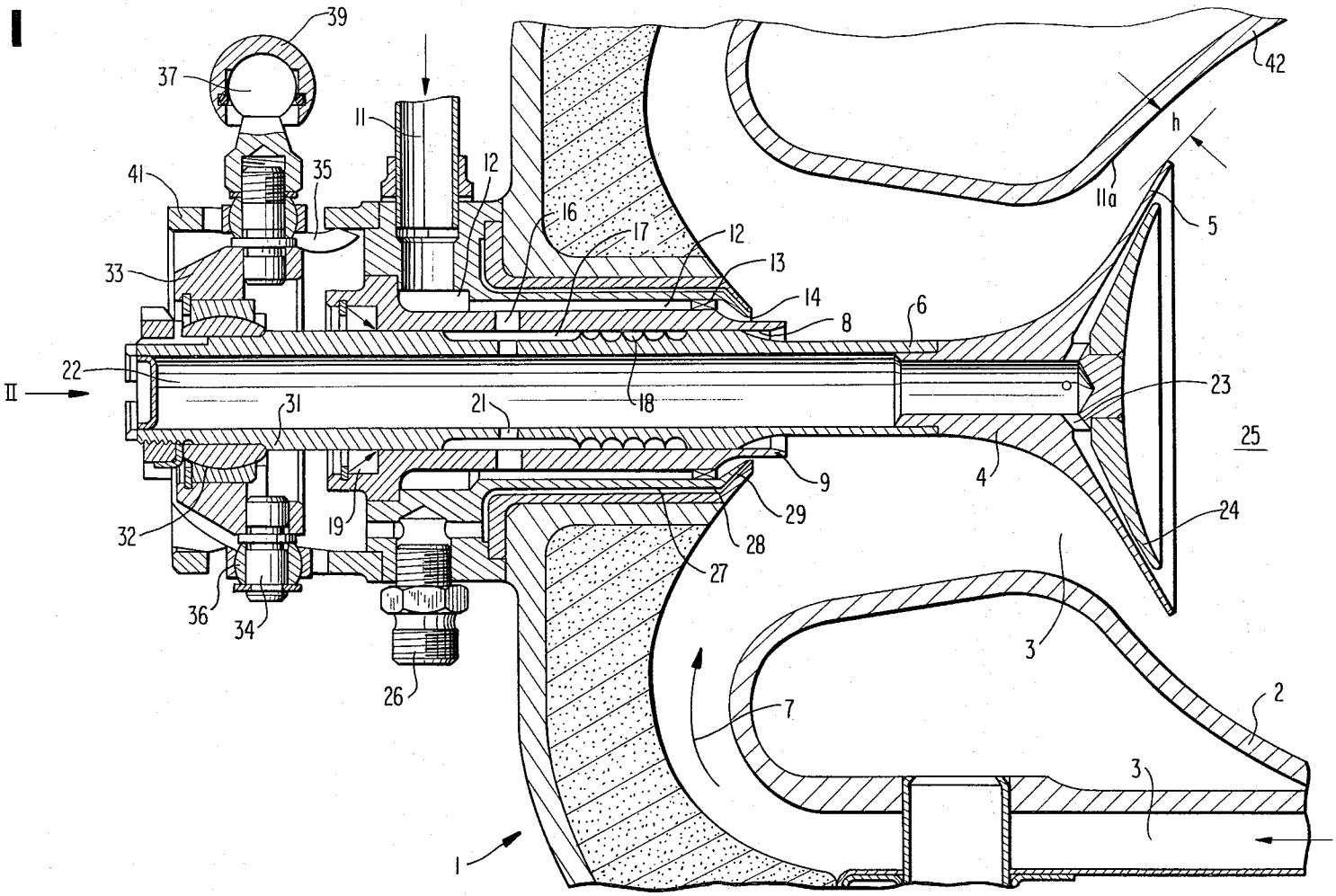
FIG. 1 is a partial longitudinal cross-sectional view through the combustion chamber head with the inflow channel for the primary air and with the air atomizing nozzle as well as with the flame holder actuation in accordance with the present invention.
Figure 4:
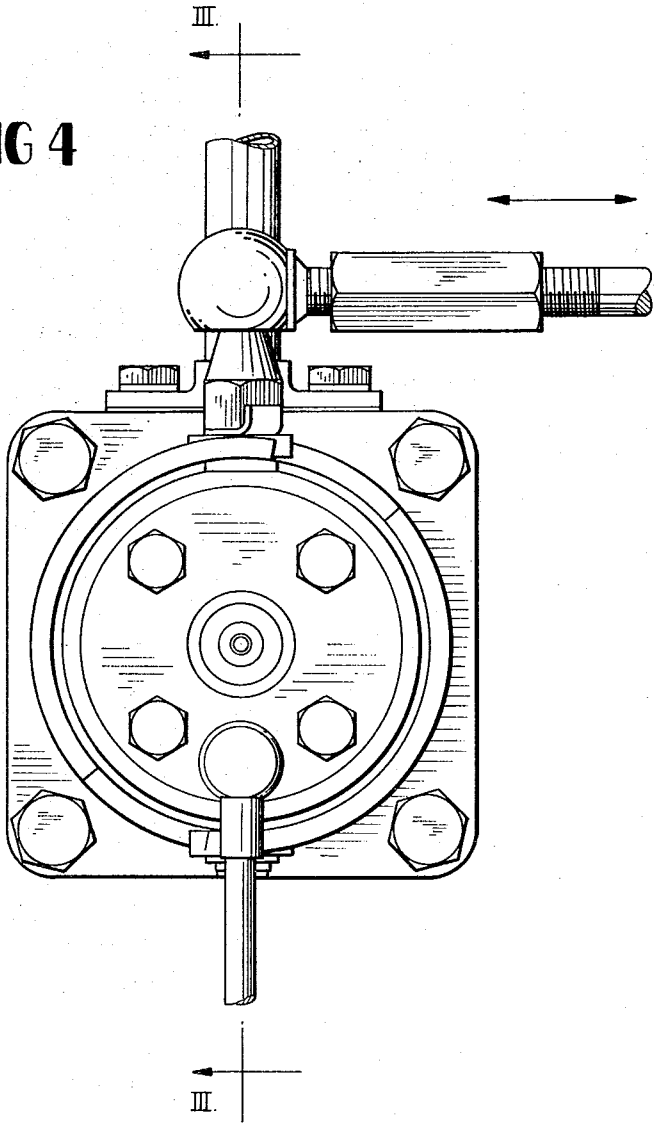
Figure 3:
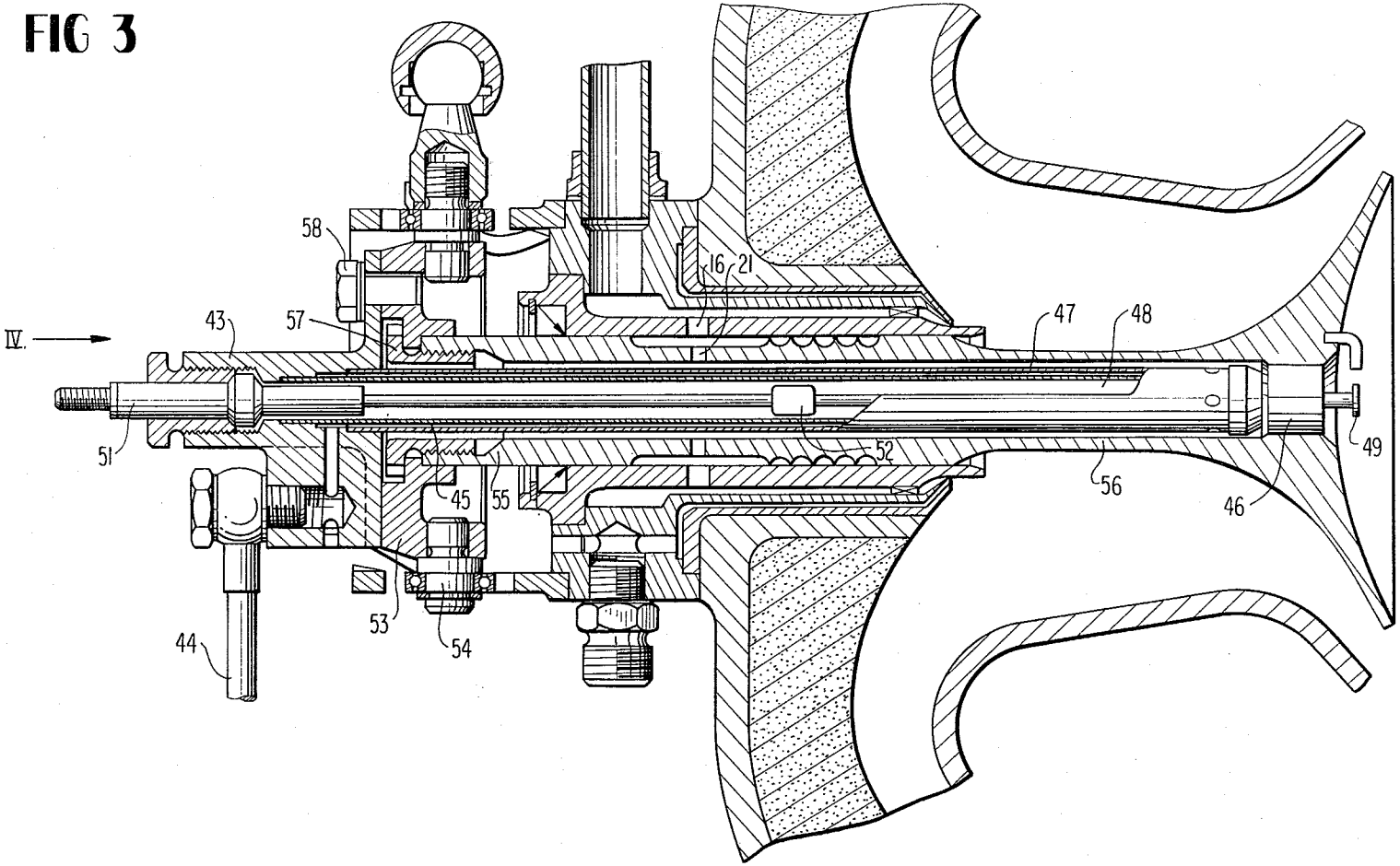

FIG. 3 is a partial longitudinal cross-sectional view through a modified embodiment of a combustion chamber head in accordance with the present invention, similar to FIG. 1, with a concentrically installed auxiliary burner whose atomizing part is equipped with an air-atomizing nozzle; and FIG. 4 is an end elevational view of the combustion chamber head illustrated in FIG. 3, taken in the direction of the arrow IV in FIG. 3.

Referring now to the drawing wherein like reference numerals are used throughout a various views to designate like parts, in the combustion chamber head generally designated by reference numeral 1 and illustrated in FIG. 1, an inlet cross section with the height h for the primary air supplied to the combustion chamber 2 of a vehicle gas turbine (not shown) by way of the inflow or inlet channel 3, is changed by an axial longitudinal movement of the flame holder 4 having the deflection disk 5 and the shaft 6. The flow of the primary air is thereby indicated by the arrow 7. The shaft 6 of the flame holder 4 is inserted through an internal bore 8 of an air-atomizing nozzle 9 whose atomizing principle is known as such.

The atomizing air enters into an annular channel 12 through a connection 11. The main part of the atomizing air flows through helical or swirl slots 13 in order to exit subsequently thereto out of the atomizer nozzle 9 with a high velocity by way of an annular gap 14. A small portion of the atomizing air enters through bores 16 into an annular channel 17 and is closed off thereat with respect to the inflow channel 3 by labyrinth seals 18. A sealing ring 19 takes over the sealing function with respect to the outside. A further second bore 21 brings cooling air to an internal bore 22 of the shaft 6, which enters through bores 23 and gap 24 into the combustion zone 25 and as a result thereof cools the flame holder disk 5.

The fuel enters through a connecting nipple 26 into an annular channel 27, from which it exits through the helical or swirl slots 28 and distributes itself as a film on a shoulder 29. The discharged fuel is seized and atomized by the atomizing air flowing out of the annular gap 14. The annular jet of the air/fuel mixture which forms thereby is discharged nearly perpendicularly to the flow direction of the primary air and as a result thereof can penetrate the same rapidly and mix with the same. The flow direction of the primary air is indicated by the aforementioned arrow 7.

The atomizing air can be taken off from the overall air flow at the outlet out of the compressor of the gas turbine and in those cases in which the available pressure drop to the discharge into the inflow channel 3 does not suffice can be brought to the pressure required for a good atomization by an additional air pump. It may thereby be appropriate to take off the portion of the air required as blocking and cooling air, separately from the cooling air stream also downstream of the drive unit compressor and to provide only bores 16 while omitting the bores 21. In this case, the blocking and cooling air at the outer end 31 of the flame holder shaft 6 is introduced directly into the internal bore 22 of the shaft 6.

Figure 2:
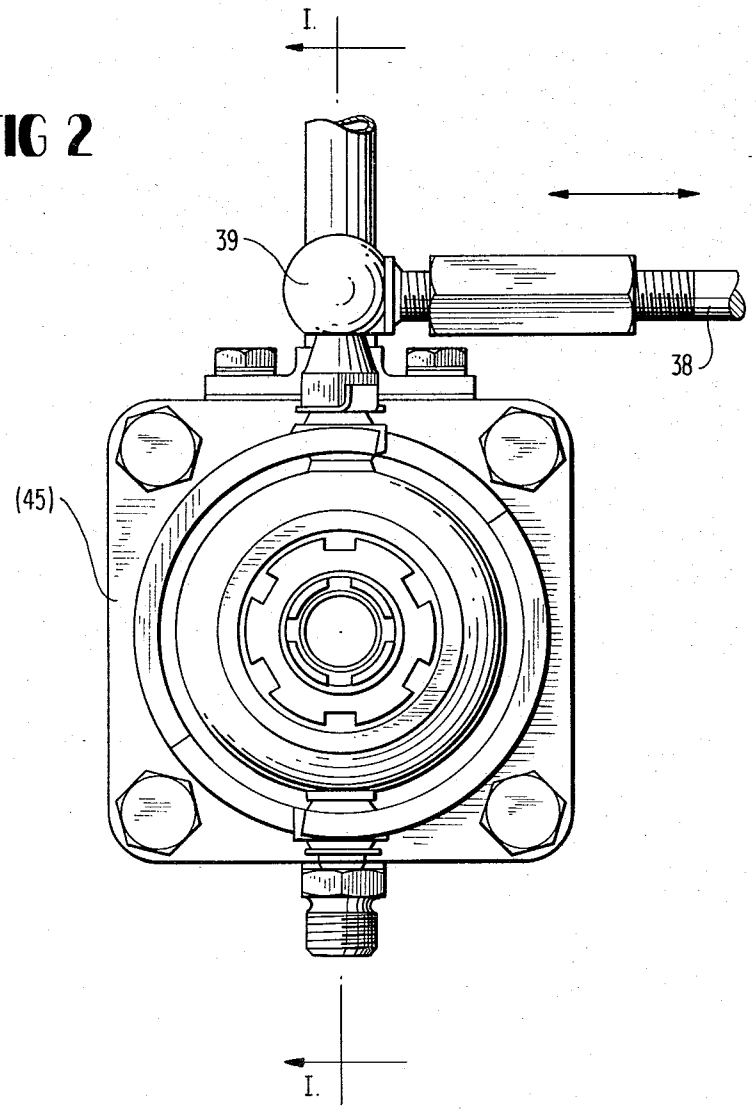
FIG. 2 is an end elevational view of the combustion chamber head, taken in the direction of the arrow II in FIG. 1.

A ring 33 is secured at the outer end 31 of the shaft by means of a ball and socket joint 32 as an angularly movable connecting member, which receives two, three or four bolts 34 which are guided in helically shaped grooves 35. The bolts 34 may be constructed spherically within the area of the guide grooves 35. For purposes of reducing friction, however, also ball and socket joints 36 or ring shoulder ball bearings (not shown herein) of conventional construction may also be provided. A ball pin 37 is mounted on one of the bolts 34 so that the ring 33 can be rotated on the flame holder shaft 6 by way of a linkage 38 with the ball socket 39, illustrated in FIG. 2, from a hydraulic or electric servomotor (not shown). As a result of the pitch of the guide grooves 35 in the guide flange member 41 of, for example, 45°, the flame holder 4 receives an axial displacement, as a result of which the gap with the dimension h between the outer edge of the flame holder disk 5 and the combustion chamber wall 42 is adjusted. As a result of the ball and socket joint 32, a stressing with respect to the guidance in the flange member 41 is prevented so that altogether the greatest possible ease of movement and an accurate adjustment are readily attainable.

In the embodiment illustrated in FIG. 3, the auxiliary burner 46 receives its atomizing air through bores 16 and 21. However, also in this case, this air may be supplied directly through a flange member 43.

The auxiliary fuel reaches by way of a line 44 an annular channel 45 and by way of the latter the nozzle 46. The atomizing air also flows by way of the bores 21 through an annular channel 47 to the nozzle 46. The electrode 49 of a high-voltage spark plug 51 extends through an inner bore 48. The spark plug 51 is screwed into the flange member 43 in the illustrated embodiment. The electrode 49 is centered in the internal bore 48 of the nozzle 46 by ceramic spacer rings 52.

The remaining parts correspond in their function and construction to the arrangement according to FIG. 1. In lieu of the ring 33, however, a ring 53 is provided in this embodiment which carries the pins 54, is form-lockingly mounted over the end 55 of the shaft 56 and is secured by means of the collar screw bush 57. Finally, the flange member 43 which is threadably secured at the pin ring 53 by means of bolts 58, carries the auxiliary burner 46.

While I have shown and described only two embodiments in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A combustion chamber for a gas turbine, comprising:

ring-shaped atomizing nozzle means having swirl slot means for injecting a swirling mixture of fuel and air into a primary air flow, pre-chamber means having a primary air in flow means, combustion zone means having a primary air inlet means with a cross section, deflection body means projecting through the inlet means of the combustion zone means and serving as flame holder means for the stabilizing of a combustion in a primary air zone means, and means for changing the cross section of the primary air inlet means by a longitudinal movement of the deflection body means, said nozzle means causing the swirling mixture of fuel and air to enter the primary air inflow means as an annular jet disposed approximately concentrically around said flame holder means and to impinge approximately perpendicularly onto the primary air flow penetrating said primary air flow and uniformly mixing therewith.

2. A combustion chamber according to claim 1, wherein means are provided for automatically adjusting a quantity of the primary air to be introduced into the combustion chamber.

3. A combustion chamber according to one of claims 1 or 2, wherein the atomizing nozzle means is an air-atomizing nozzle.

4. A combustion chamber according to claim 3, wherein the gas turbine is for motor vehicles.

5. A combustion chamber according to one of claims 1 or 2, wherein the flame holder means includes a shaft extending through an internal bore of the nozzle means, and wherein the means for changing the cross section of the primary air inlet means is actuatable from outside in such a manner that a quantity of primary air to be introduced is optimally controlled.

6. A combustion chamber according to claim 5, an annular channel means surrounds a portion of the shaft of the flame holder means, cross bore means are provided for supplying a portion of the atomizing air to the channel means, labyrinth seal means are provided along a periphery of the shaft of the flame holder means for sealing the annular channel means with respect to the prechamber means and for preventing a through-flow of hot combustion air as leakage air along the shaft of the flame holder means.

7. A combustion chamber according to claim 6, wherein the means for changing the cross section of the primary air inlet means includes a leakage means movable transversely to the longitudinal movement of the deflection body means so as to enable an automatic adjustment of the deflection body means, a ring means operatively connected with the shaft of the flame holder means and with the linkage means, a guide flange means is provided for guiding the ring means, the guide flange means includes helical grooves, ball and socket joint means are operatively connected with the ring means and are guided in the helical grooves so that upon a pivoting of the ring means the deflection body means is longitudinally displaced.

8. A combustion chamber according to claim 7, wherein said ring means is pivotally connected with the shaft of the flame holder means.

9. A combustion chamber according to claim 7, characterized in that the ring means is form-lockingly connected with the shaft.

10. A combustion chamber according to claim 7, wherein in an auxiliary burner means is arranged in the shaft of the flame holder means concentrically thereto, means extending substantially centrally through the of the flame holder means are provided for supplying air to the auxiliary burner means, and an annular channel means is provided for supplying fuel to the auxiliary burner means.

11. A combustion chamber according to claim 10, wherein the auxiliary burner means includes an ignition electrode arranged essentially along a longitudinal axis of the shaft of the flame holder means.

12. A combustion chamber according to one of claims 1 or 2, an annular channel means surrounds a portion of the shaft of the flame holder means, cross bore means are provided for supplying a portion of the atomizing air to the channel means, labyrinth seal means are provided along a periphery of the shaft of the flame holder means for sealing the annular channel means with respect to the prechamber means and for preventing a through-flow of hot combustion air as leakage air along the shaft of the flame holder means.

13. A combustion chamber according to one of claims 1 or 2, wherein the means for changing the cross section of the primary air inlet means includes a leakage means movable transversely to the longitudinal movement of the deflection body means so as to enable an automatic adjustment of the deflection body means, a ring means operatively connected with the shaft of the flame holder means and with the linkage means, a guide flange means is provided for guiding the ring means, the guide flange means includes helical grooves, ball and socket joint means are operatively connected with the ring means and are guided in the helical grooves so that upon a pivoting of the ring means the deflection body means is longitudinally displaced.

14. A combustion chamber according to one of claims 1 or 2, wherein in an auxiliary burner means is arranged in the shaft of the flame holder means concentrically thereto, means extending substantially centrally through the of the flame holder means are provided for supplying air to the auxiliary burner means, and an annular channel means is provided for supplying fuel to the auxiliary burner means.

15. A combustion chamber according to claim 14, wherein the auxiliary burner means includes an ignition electrode arranged essentially along a longitudinal axis of the shaft of the flame holder means.

* * * * *